US005829279A

United States Patent [19]

Wu

[11] Patent Number: 5,829,279

[45] Date of Patent: Nov. 3, 1998

[54] DEVICE FOR WASHING CLOTHES

[76] Inventor: Fuji Wu, No. 43-3, Kgo Sion Road, Shen Kang Hsiang, Tai- Chung, Taiwan

[21] Appl. No.: 898,600

[22] Filed: Jul. 22, 1997

[51] Int. Cl.[6] ..... G06F 3/02

[52] U.S. Cl. ..... 68/229

[58] Field of Search ..... 68/223, 224, 225, 68/226, 227, 228, 229, 230, 14, 92, 220; 15/222, 215, 216, 217, 188, 237, 238; D32/67; 248/27.5; 601/135, 137, 138; 401/6

[56] References Cited

U.S. PATENT DOCUMENTS

| | | | |
|---|---|---|---|
| 728,159 | 5/1903 | Burkart | 15/222 X |
| 1,006,630 | 10/1911 | Clarke | 15/188 |
| 1,473,315 | 11/1923 | Poirier | 15/222 |
| 1,526,267 | 2/1925 | Dessau | 15/188 X |
| 1,579,089 | 3/1926 | Davison | 15/222 |
| 2,271,512 | 2/1942 | Griffiths | 68/220 |
| 2,333,436 | 11/1943 | Novick | 15/222 X |
| 2,807,815 | 10/1957 | Mack | 15/222 X |
| 2,904,038 | 9/1959 | Hackney | 601/138 |
| 3,890,812 | 6/1975 | Sunday | 68/224 |
| 5,058,403 | 10/1991 | Barnes | 68/229 |

*Primary Examiner*—Philip R. Coe
*Attorney, Agent, or Firm*—Bacon & Thomas, PLLC

[57] ABSTRACT

A device includes a flexible board and a plate, the board having an aperture defined in a first end thereof and a plurality of ridges extending transversely from a top surface thereof, the plate having a head portion formed to a first end thereof and a position member extending from a second end thereof so that the position member is securely received in the aperture. The plate has at least one hole defined therein so that the board is wrapped by the plate and the position member is engaged with a periphery defining the hole.

6 Claims, 7 Drawing Sheets

DEVICE FOR WASHING CLOTHES

BACKGROUND OF THE INVENTION

1. Field Of The Invention

The present invention relates to a device on which clothes can be washed and, more particularly, to a board like washing device which has ridges extending transversely from a top surface thereof and is foldable and has a light weight.

2. Brief Description Of The Prior Art

In some countries or areas, there are no washing machines that can be used so that people use a board to wash clothes thereon. In Asia, there are many people who use such boards to wash their clothes, especially the students who leave their homes for school and live in other towns. The board has a plurality of grooves and ridges formed on a top thereof so that clothes are scrapped reciprocatedly on the top of the board. Generally, the board is made of wood so that it occupies a lot of space when not used and is inconvenient for transportation. Furthermore, there has no sufficient friction between a supporting surface on which the board is put and a bottom of the board so that it slides when exerting a force to the board. In addition, it takes a long time to dry the board.

The present invention intends to provide a device on which clothes can be washed and the device is foldable and light-weighted so that the above-mentioned problems can be mitigated and/or obviated.

SUMMARY OF THE INVENTION

In one aspect of the present invention, there is provided a device for washing clothes and comprising a flexible board and a plate, the board having an aperture defined in a first end thereof and a plurality of ridges extending upwardly and transversely from a top surface thereof. The plate has a head portion extending longitudinally from a first end thereof and a position member extending upwardly from a second end thereof so that the position member is disengagably received in the aperture when washing clothes on the board.

It is an object of the present invention to provide a device for washing clothes wherein the board can be positioned by connecting a plate thereto on which a user steps.

It is another object of the present invention to provide a device for washing clothes wherein the board can be scrolled and wrapped by the plate.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
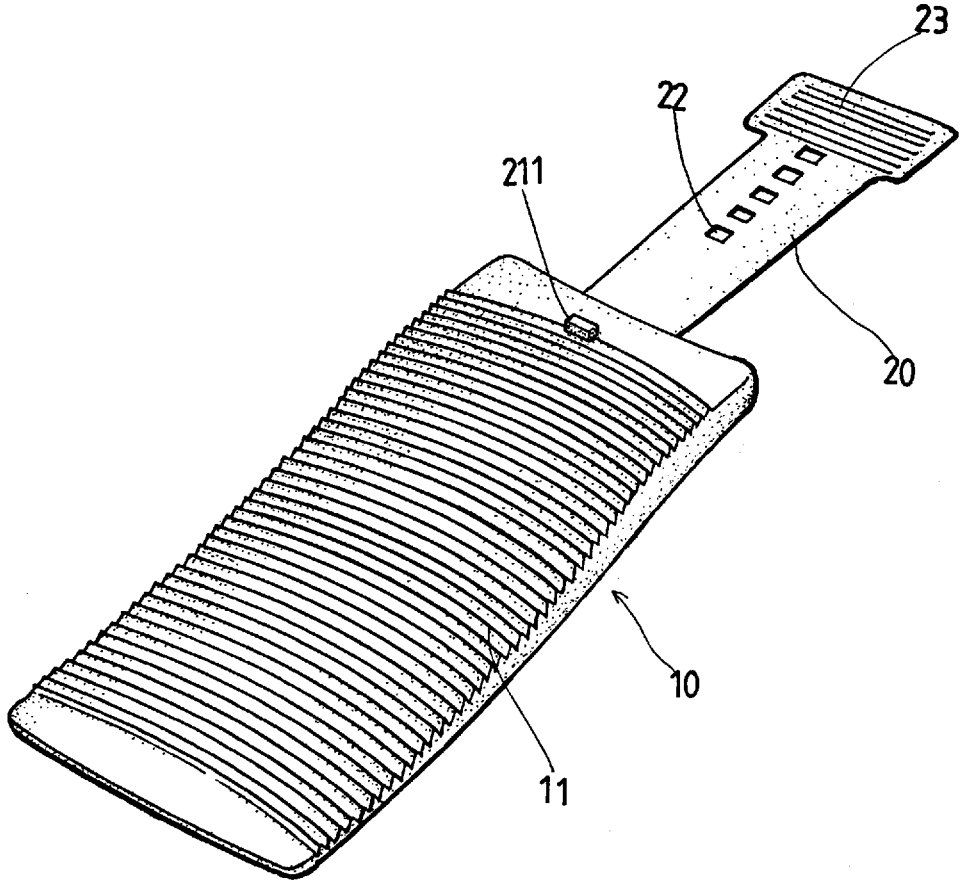
FIG. 1 is a perspective view of a board and a plate connected to the board in accordance with the present invention.
Figure 2:
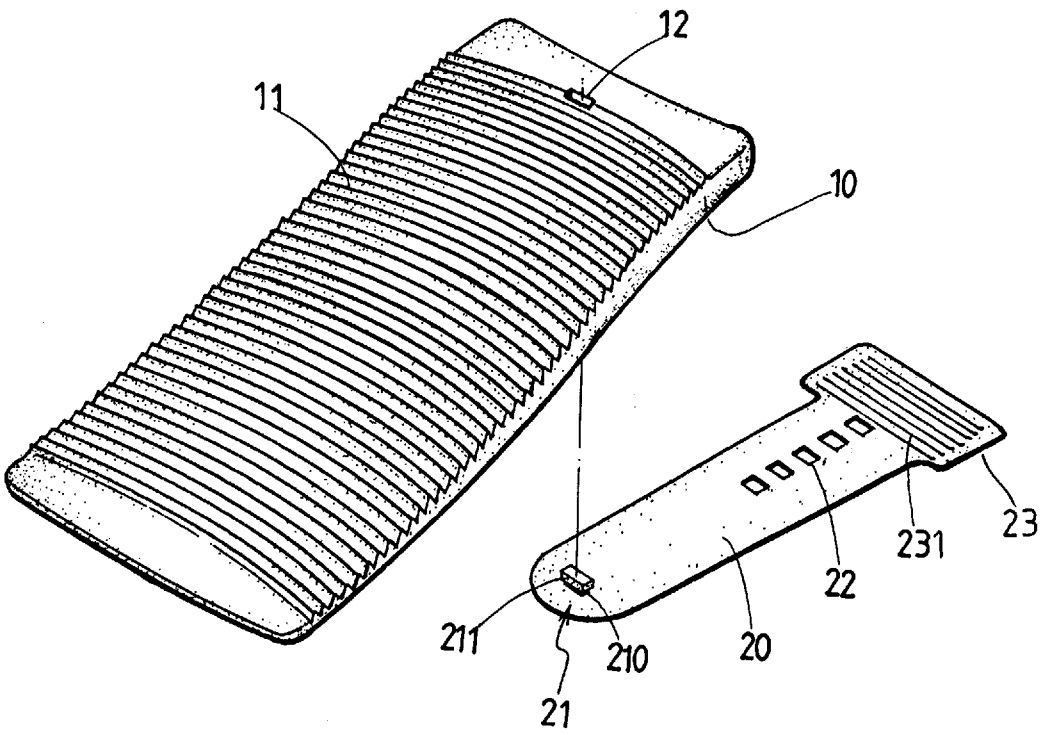
FIG. 2 is an exploded view of the board and the plate in accordance with the present invention.
Figure 5:
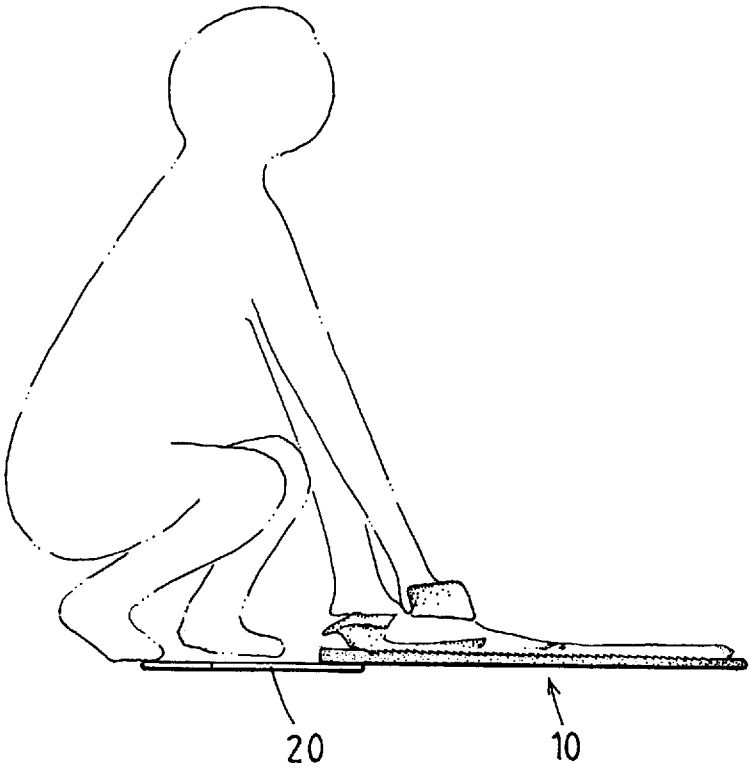
FIG. 5 is an illustrative view to show a user using the device to wash clothes.

Referring to the drawings and initially to FIGS. 1, 2 and 5, a device for washing clothes in accordance with the present invention generally includes a flexible board 10 and a plate 20 wherein the board 10 is made of flexible material so that it can be scrolled and may have a lot of colors. The board 10 has a first end and a second end, a thickness of the first end of the board 10 is thicker than that of the second end of the board 10 so that when the board 10 is put on a horizontal supporting surface, a top surface of the board 10 is inclined to the horizontal supporting surface as shown in FIG. 5. The first end of the board 10 has an aperture 12 defined therein and a plurality of ridges 11 extend upwardly and transversely from the top surface of the board 10.

The plate 20 is also made of flexible material and has a head portion 23 extending longitudinally from a first end thereof and a position member 21 extending upwardly from a second end thereof so that the position member 21 is disengagably received in the aperture 12. The position member 21 includes a neck 210 extending from the plate 20 and a head 211 formed on a top of the neck 210 wherein the head 211 is sized slightly larger than a periphery defining the aperture 12 so that the head 211 is able to be securely received in the aperture 12. The plate 20 has at least one hole, for example five holes 22, defined therethrough.

Figure 3:
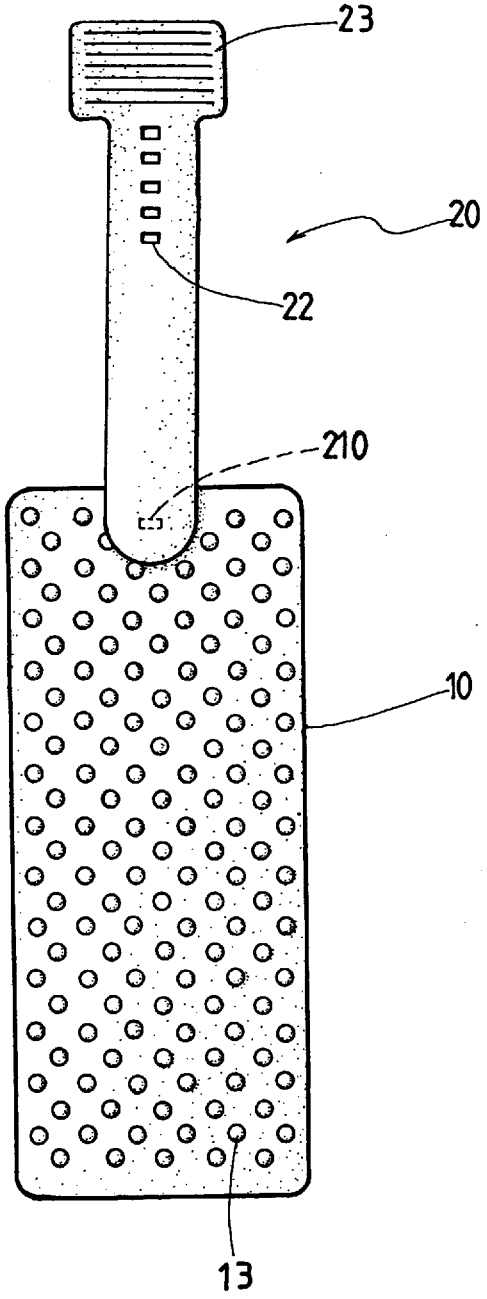
FIG. 3 is a bottom plan view of the board and the plate.
Figure 4:
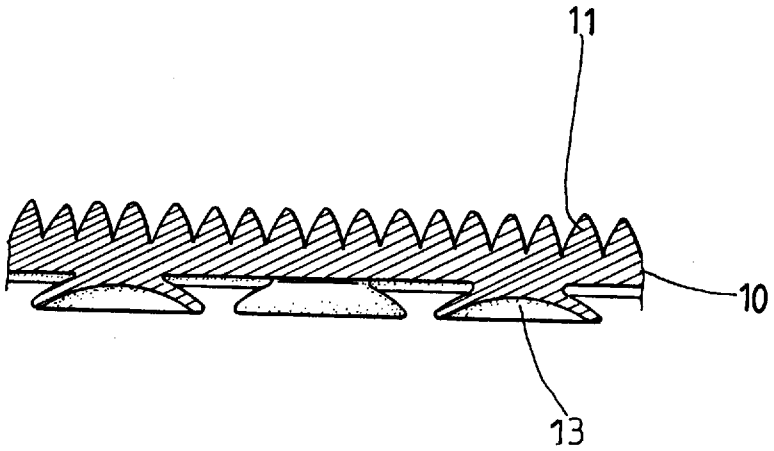
FIG. 4 is a sectional view, partly in section, of the board.

Referring to Figs.3 and 4, the board 10 has a plurality of friction members such as suction disks 13 disposed to a bottom surface thereof so that when using the board 10, the board will not slide on the wet horizontal supporting surface. It is noted that there are many parallel strips 231 extending from both a top and a bottom surface of the head portion 23 of the plate 20 so that the plate 20 can be securely positioned when a user steps on the head portion 23 as shown in FIG. 5.

Figure 6:
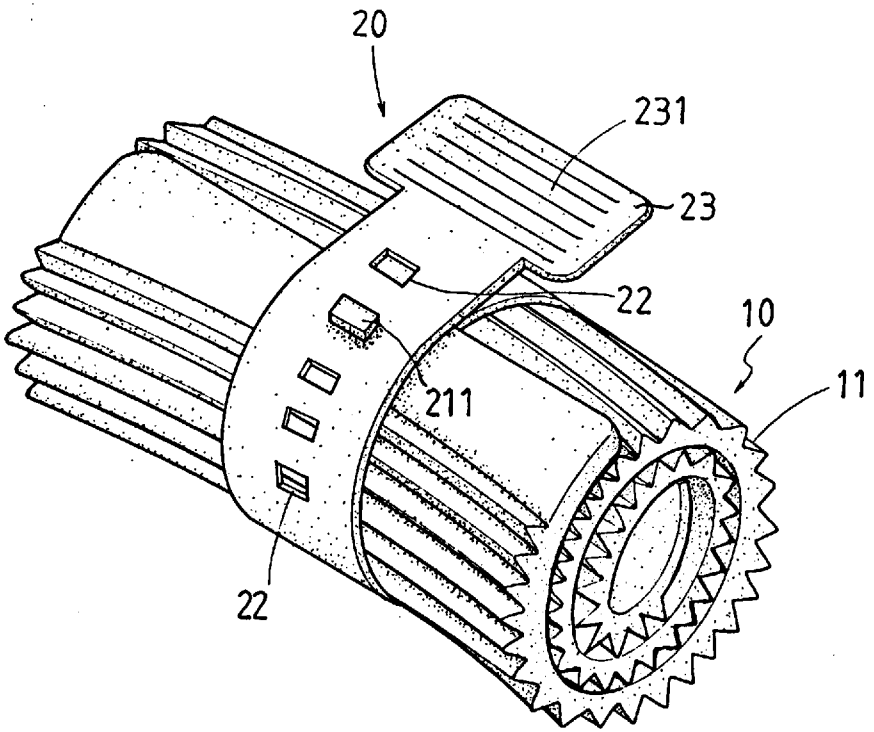
FIG. 6 is a perspective view to show the board is wrapped by the plate.

Referring to FIG. 6, the board 10 can be scrolled and is wrapped by the plate 20 with the position member 21 received in one of the holes 22 so that the device occupies a small space.

Figure 7:
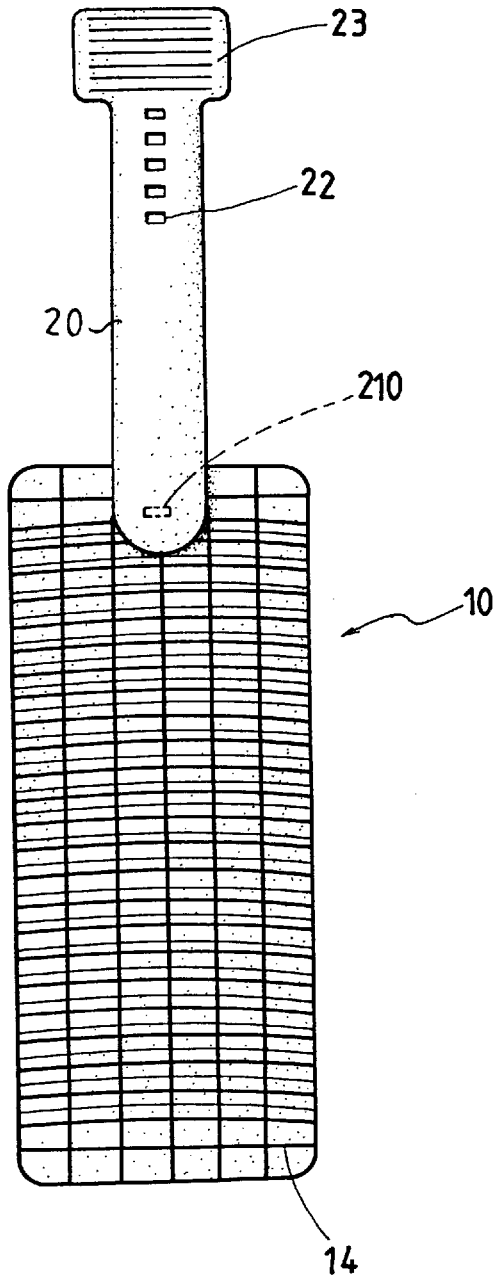
FIG. 7 is a bottom plan view of another embodiment of the board and the plate.

FIG. 7 shows another embodiment of the friction members which are crossed or netted protrusion 14.

The board 10 and the plate 20 can be manufactured to include a plurality of colors as needed and have an advantage that both of the board 10 and the plate 20 can be dried up in a short time.

Although the invention has been explained in relation to its preferred embodiment, it is to be understood that many other possible modifications and variations can be made without departing from the spirit and scope of the invention as hereinafter claimed.

What is claimed is:

1. A device for washing clothes comprising:

a flexible board having an aperture defined in a first end thereof and a plurality of ridges extending upwardly and transversely from a top surface thereof, and a plate having a head portion extending longitudinally from a first end thereof and a position member extending upwardly from a second end thereof so that said position member is disengagably received in said aperture.

2. The device as claimed in claim 1 wherein said plate has at least one hole defined therethrough so as to receive said position member when said plate wraps around said board.

3. The device as claimed in claim 1 wherein said position member includes a neck extending from said plate and a head formed on a top of said neck.

4. The device as claimed in claim 1 wherein a thickness of said first end of said board is thicker than that of said second end of said board.

5. The device as claimed in claim 1 wherein said board has a plurality of friction members disposed to a bottom surface thereof.

6. The device as claimed in claim 5 wherein said friction members are suction disks.

* * * * *